US010186220B2

(12) United States Patent
Sohn et al.

(10) Patent No.: US 10,186,220 B2
(45) Date of Patent: Jan. 22, 2019

(54) GATE DRIVER, A DISPLAY APPARATUS HAVING THE GATE DRIVER AND A METHOD OF DRIVING THE DISPLAY APPARATUS

(71) Applicant: SAMSUNG DISPLAY CO., LTD., Yongin-si, Gyeonggi-Do (KR)

(72) Inventors: Young-Soo Sohn, Guri-si (KR); Neung-Beom Lee, Hwaseong-si (KR); Jeong-Hyun Kim, Cheonan-si (KR); Jin-Seuk Kim, Hwaseong-si (KR); Won-Hee Lee, Bucheon-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 352 days.

(21) Appl. No.: 15/054,580

(22) Filed: Feb. 26, 2016

(65) Prior Publication Data

US 2017/0053585 A1 Feb. 23, 2017

(30) Foreign Application Priority Data

Aug. 20, 2015 (KR) ..... 10-2015-0117473

(51) Int. Cl.
*G09G 3/36* (2006.01)
*G09G 3/20* (2006.01)

(52) U.S. Cl.
CPC ..... *G09G 3/3674* (2013.01); *G09G 3/20* (2013.01); *G09G 2310/0248* (2013.01); *G09G 2310/0267* (2013.01)

(58) Field of Classification Search
CPC ..... G09G 3/3674; G09G 2310/0248; G09G 2310/0267; G09G 3/20
See application file for complete search history.

(56) References Cited

U.S. PATENT DOCUMENTS

2004/0041760 A1* 3/2004 Tsumura ..... G09G 3/342 345/87
2005/0195671 A1* 9/2005 Taguchi ..... G02F 1/13306 365/203
2005/0237831 A1* 10/2005 Ishii ..... G09G 3/20 365/201

(Continued)

FOREIGN PATENT DOCUMENTS

KR 1020150050202 5/2015
KR 2016-0045176 4/2016

*Primary Examiner* — Amare Mengistu
*Assistant Examiner* — Crystal A Mathews
(74) *Attorney, Agent, or Firm* — F. Chau & Associates, LLC

(57) ABSTRACT

A gate driver includes a first shift-register including a plurality of odd-numbered stages which outputs a plurality of odd-numbered original gate signals having a pre-charge pulse and a main-charge pulse in synchronization with a first gate clock signal, a second shift-register comprising a plurality of even-numbered stages which outputs a plurality of even-numbered original gate signals having a pre-charge pulse and a main-charge pulse in synchronization with a second gate clock signal, a first inverter configured to output a first inversion pre-charge control signal having a phase opposite to a phase of a first pre-charge control signal, and a second inverter configured to output a second inversion pre-charge control signal having a phase opposite to a phase of a second pre-charge control signal.

17 Claims, 7 Drawing Sheets

(56) References Cited

U.S. PATENT DOCUMENTS

2006/0145991 A1* 7/2006 Jang ..... G09G 3/3677 345/94
2007/0139339 A1* 6/2007 Kim ..... G09G 3/3648 345/98
2007/0242019 A1* 10/2007 Jung ..... G09G 3/3688 345/98
2008/0067512 A1* 3/2008 Lee ..... G09G 3/3659 257/59
2010/0013802 A1* 1/2010 Hosaka ..... G09G 3/204 345/204
2010/0231617 A1* 9/2010 Ueda ..... G09G 3/3648 345/690
2010/0315403 A1* 12/2010 Kaneyoshi ..... G09G 3/3614 345/211
2011/0221729 A1* 9/2011 Chuang ..... G09G 3/3648 345/211
2012/0218317 A1* 8/2012 Choi ..... G09G 3/3655 345/690
2013/0033481 A1* 2/2013 Kang ..... G09G 3/3648 345/215
2013/0099692 A1* 4/2013 Chaji ..... H05B 37/02 315/224
2014/0118331 A1* 5/2014 Jeon ..... G09G 3/3614 345/213
2014/0320521 A1* 10/2014 Oh ..... G09G 5/02 345/601
2015/0022512 A1* 1/2015 Ahn ..... G09G 3/3607 345/212
2015/0035866 A1* 2/2015 Ahn ..... G09G 5/10 345/690
2015/0187297 A1* 7/2015 Park ..... G09G 3/3677 345/99
2015/0194119 A1* 7/2015 Ahn ..... G09G 3/3696 345/213

* cited by examiner

FIG. 3A

| LINE | D_AVG | H_COUNT | L_COUNT | RESULT |
|---|---|---|---|---|
| 1 | 230 | 7000 | 10 | HIGH |
| 2 | 128 | 15 | 12 | DON'T CARE |
| 3 | 12 | 0 | 6800 | LOW |
| 4 | 160 | 160 | 50 | DON'T CARE |
| 5 | 91 | 91 | 79 | DON'T CARE |
| ... | ... | ... | | |
| 2159 | 240 | 7100 | 3 | HIGH |
| 2160 | 245 | 7200 | 6 | HIGH |

FIG. 3B

| | LINE | | | | | | | | | |
|---|---|---|---|---|---|---|---|---|---|---|
| | 1 | 2 | 3 | 4 | 5 | 6 | ... | 2158 | 2159 | 2160 |
| PC_D | 0 | 0 | 1 | 0 | 0 | 0 | ... | 0 | 0 | 0 |

GATE DRIVER, A DISPLAY APPARATUS HAVING THE GATE DRIVER AND A METHOD OF DRIVING THE DISPLAY APPARATUS

CROSS-REFERENCE TO RELATED APPLICATION

This application claims priority under 35 U.S.C. § 119 to Korean Patent Application No. 10-2015-0117473 filed on Aug. 20, 2015, the disclosure of which is incorporated by reference herein in its entirety.

TECHNICAL FIELD

Exemplary embodiments of the inventive concept relate to a gate driver, a display apparatus having the gate driver, and a method of driving the display apparatus.

DESCRIPTION OF THE RELATED ART

Generally, a liquid crystal display (LCD) apparatus includes a first substrate including a pixel electrode, a second substrate including a common electrode and a liquid crystal layer disposed between the first and second substrates. An electric field is generated in the liquid crystal layer by voltages applied to the pixel electrode and the common electrode. By adjusting an intensity of the electric field, a transmittance of a light passing through the liquid crystal layer may be adjusted so that a desired image may be displayed.

Generally, a display apparatus includes a display panel and a panel driver. The display panel includes a plurality of gate lines, a plurality of data lines and a plurality of pixels connected to the gate lines and the data lines. The panel driver includes a gate driver for providing gate signals to the gate lines and a data driver for providing data voltages to the data lines.

To increase a charging rate of the pixel, a pre-charge driving mode has been used. In the pre-charge driving mode, an N-th gate line may be activated before an N-th horizontal period. However, when pre-charging is excessive in the pre-charge driving mode, the pixel may be overcharged, and thus, the pixel may have a luminance higher than a desired grayscale. Thus, a ghost defect may occur at the pixel.

SUMMARY

According to an exemplary embodiment of the inventive concept, there is provided a gate driver. The gate driver includes a first shift-register comprising a plurality of odd-numbered stages which outputs a plurality of odd-numbered original gate signals respectively having a pre-charge pulse and a main-charge pulse, in synchronization with a first gate clock signal, a second shift-register comprising a plurality of even-numbered stages which outputs a plurality of even-numbered original gate signals having a pre-charge pulse and a main-charge pulse, in synchronization with a second gate clock signal, a first inverter configured to output a first inversion pre-charge control signal having a phase opposite to a phase of a first pre-charge control signal, a second inverter configured to output a second inversion pre-charge control signal having a phase opposite to a phase of a second pre-charge control signal, a first AND-circuit configured to perform an AND operation on a first odd-numbered original gate signal and the first inversion pre-charge control signal, a second AND-circuit configured to perform the AND operation on a second odd-numbered original gate signal and the second inversion pre-charge control signal, a third AND-circuit configured to perform an AND operation on a first even-numbered original gate signal and the first inversion pre-charge control signal, and a fourth AND-circuit configured to perform the AND operation on a second even-numbered original gate signal and the second inversion pre-charge control signal.

According to an exemplary embodiment of the inventive concept, there is provided a display apparatus. The display apparatus includes a display panel comprising a plurality of pixels arranged in a plurality of pixel rows and a plurality of pixel columns, and a plurality of horizontal lines corresponding to the plurality of pixel rows, a control data generator configured to generate pre-charge control data of an N-th horizontal line by comparing image data of an (N−2)-th horizontal line and image data of the N-th horizontal line ('N' is a natural number), a pre-charge controller configured to generate a pre-charge control signal based on the pre-charge control data, and a gate driver configured to generate an N-th gate signal having a pre-charge pulse and a main-charge pulse delayed from the pre-charge pulse by one horizontal period, and to control the pre-charge pulse of the N-th gate signal based on the pre-charge control signal.

In an exemplary embodiment of the inventive concept, the control data generator may be configured to calculate comparison data of the N-th horizontal line using the image data of the N-th horizontal line and calculate comparison data of the (N−2)-th horizontal line using image data of the (N−2)-th horizontal line, and to determine the pre-charge control data as high data if the comparison data of the N-th and (N−2)-th horizontal lines have a ghost condition and determine the pre-charge control data as low data if the comparison data of the N-th and (N−2)-th horizontal lines do not have the ghost condition.

In an exemplary embodiment of the inventive concept, the comparison data may include average data of image data of a horizontal line, high-number data counting number of the image data being higher than a high threshold grayscale, and low-number data counting number of the image data being lower than a low threshold grayscale.

In an exemplary embodiment of the inventive concept, the gate driver may include a shift-register comprising a plurality of stages which generates a plurality of original gate signals respectively having a pre-charge pulse and a main-charge pulse synchronized with a gate clock signal in response to a vertical synchronization signal, a first inverter configured to output a first inversion pre-charge control signal having a phase opposite to a phase of a first pre-charge control signal, the first pre-charge control signal controls a pre-charge pulse of an odd-numbered original gate signal provided from an odd-numbered stage, a second inverter configured to output a second inversion pre-charge control signal having a phase opposite to a phase of a second pre-charge control signal, the second pre-charge control signal controls a pre-charge pulse of an even-numbered original gate signal provided from an even-numbered stage, a first AND circuit configured to perform an AND operation on the odd-numbered original gate signal and the first inversion pre-charge control signal, and a second AND circuit configured to perform the AND operation on the even-numbered original gate signal and the second inversion pre-charge control signal.

In an exemplary embodiment of the inventive concept, the gate driver may include a first shift-register comprising a plurality of odd-numbered stages which outputs a plurality of odd-numbered original gate signals respectively having a pre-charge pulse and a main-charge pulse, in synchronization with a first gate clock signal, and a second shift-register comprising a plurality of even-numbered stages which outputs a plurality of even-numbered original gate signals respectively having a pre-charge pulse and a main-charge pulse, in synchronization with a second gate clock signal.

In an exemplary embodiment of the inventive concept, the gate driver may further include a first inverter configured to output a first inversion pre-charge control signal having a phase opposite to a phase of a first pre-charge control signal, a second inverter configured to output a second inversion pre-charge control signal having a phase opposite to a phase of a second pre-charge control signal, a first AND circuit configured to perform an AND operation on a first odd-numbered original gate signal and the first inversion pre-charge control signal, a second AND circuit configured to perform the AND operation on a second odd-numbered original gate signal and the second inversion pre-charge control signal, a third AND circuit configured to perform the AND operation on a first even-numbered original gate signal and the first inversion pre-charge control signal, and a fourth AND circuit configured to perform the AND operation on a second even-numbered original gate signal and the second inversion pre-charge control signal.

According to an exemplary embodiment of the inventive concept, there is provided a method of driving a display apparatus which comprises a plurality of pixels arranged in a plurality of pixel rows and a plurality of pixel columns and a plurality of horizontal lines corresponding to the plurality of pixel rows. The method includes generating pre-charge control data of an N-th horizontal line by comparing image data of an (N−2)-th horizontal line and image data of the N-th horizontal line ('N' is a natural number), generating a pre-charge control signal based on the pre-charge control data of the N-th horizontal line, generating an N-th gate signal having a pre-charge pulse and a main-charge pulse delayed from the pre-charge pulse by one horizontal period, and controlling the pre-charge pulse of the N-th gate signal based on the pre-charge control signal of the N-th horizontal line.

In an exemplary embodiment of the inventive concept, the method may further include calculating comparison data of the N-th horizontal line using image data of the N-th horizontal line, calculating comparison data of the (N−2)-th horizontal line using image data of the (N−2)-th horizontal line, and determining the pre-charge control data as high data if the comparison data of the N-th and (N−2)-th horizontal lines have a ghost condition and determining the pre-charge control data as low data if the comparison data of the N-th and (N−2)-th horizontal lines do not have the ghost condition.

In an exemplary embodiment of the inventive concept, the comparison data may include average data of image data of a horizontal line, high-number data counting number of the image data being higher than a high threshold grayscale, and low-number data counting number of the image data being lower than a low threshold grayscale.

In an exemplary embodiment of the inventive concept, the method may further include generating a plurality of original gate signals having a pre-charge pulse and a main-charge pulse in synchronization with a gate clock signal in response to a vertical synchronization signal, outputting a first inversion pre-charge control signal having a phase opposite to a phase of a first pre-charge control signal, outputting a second inversion pre-charge control signal having a phase opposite to a phase of a second pre-charge control signal, performing an AND operation on the odd-numbered original gate signal and the first inversion pre-charge control signal, and performing the AND operation on the even-numbered original gate signal and the second inversion pre-charge control signal.

In an exemplary embodiment of the inventive concept, the method may further include outputting a plurality of odd-numbered original gate signals having a pre-charge pulse and a main-charge pulse in synchronization with a first gate clock signal, and outputting a plurality of even-numbered original gate signals having a pre-charge pulse and a main-charge pulse in synchronization with a second gate clock signal.

In an exemplary embodiment of the inventive concept, the method may further include outputting a first inversion pre-charge control signal having a phase opposite to a phase of a first pre-charge control signal, the first pre-charge control signal controls a first odd-numbered original gate signal of the odd-numbered original gate signals and a first even-numbered original gate signal of the even-numbered original gate signals, outputting a second inversion pre-charge control signal having a phase opposite to a phase of a second pre-charge control signal, the second pre-charge control signal controls a second odd-numbered original gate signal of the odd-numbered original gate signals and a second even-numbered original gate signal of the even-numbered original gate signals, performing an AND operation on the first odd-numbered original gate signal and the first inversion pre-charge control signal, performing the AND operation on the second odd-numbered original gate signal and the second inversion pre-charge control signal, performing the AND operation on the first even-numbered original gate signal and the first inversion pre-charge control signal, and performing the AND operation on the second even-numbered original gate signal and the second inversion pre-charge control signal.

According to an exemplary embodiment of the inventive concept, there is provided a display apparatus, comprising: a timing controller configured to generate pre-charge control data of an N-th signal line by comparing image data of an (N−2)-th signal line and image data of the N-th signal line ('N' is a natural number), and to generate a pre-charge control signal based on the pre-charge control data; and a gate driver configured to generate an N-th gate signal having a pre-charge pulse and a main-charge pulse delayed from the pre-charge pulse by a first time period, and to control the pre-charge pulse of the N-th gate signal based on the pre-charge control signal.

The timing controller is configured to calculate comparison data of the N-th signal line using the image data of the N-th signal line, calculate comparison data of the (N−2)-th signal line using the image data of the (N−2)-th horizontal line, determine the pre-charge control data as high data if the comparison data of the N-th and (N−2)-th signal lines satisfy a first condition and determine the pre-charge control data as low data if the comparison data of the N-th and (N−2)-th signal lines do not satisfy the first condition.

The first condition is a ghost condition.

The signal lines are horizontal lines of a display panel.

BRIEF DESCRIPTION OF THE DRAWINGS

The above and other features of the inventive concept will become more apparent by describing in detail exemplary embodiments thereof with reference to the accompanying drawings, in which:

FIGS. 3A and 3B are diagrams illustrating a method of driving a control data generator in FIG. 2 according to an exemplary embodiment of the inventive concept;

DETAILED DESCRIPTION OF THE EMBODIMENTS

Hereinafter, exemplary embodiments of the inventive concept will be explained in detail with reference to the accompanying drawings.

Figure 1:
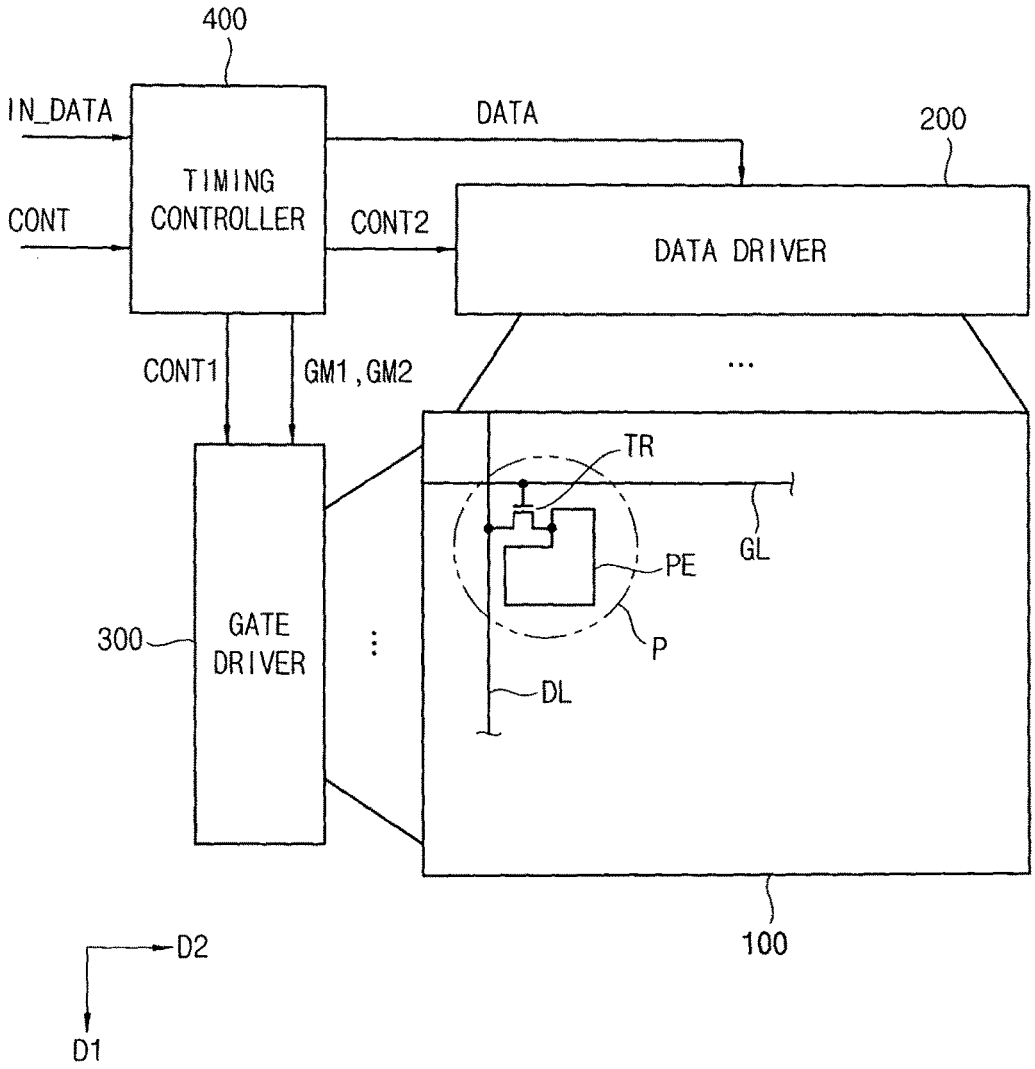
FIG. 1 is a block diagram illustrating a display apparatus according to an exemplary embodiment of the inventive concept.

FIG. 1 is a block diagram illustrating a display apparatus according to an exemplary embodiment of the inventive concept.

Referring to FIG. 1, the display apparatus may include a display panel 100, a data driver 200, a gate driver 300 and a timing controller 400.

The display panel 100 may include a plurality of data lines DL, a plurality of gate lines GL and a plurality of pixels P. The data lines DL extend in a first direction D1 and are arranged in a second direction D2 crossing the first direction D1. The gate lines GL extend in the second direction D2 and are arranged in the first direction D1. Each of the pixels P may include a thin film transistor TR which is connected to a data line DL and a gate line GL and a pixel electrode PE which is connected to the thin film transistor TR. The pixels P may be arranged in a matrix which includes a plurality of pixel columns and a plurality of pixel rows.

The data driver 200 is configured to generate a data voltage based on a control of the timing controller 400 and to output the data voltage to the data line DL.

The gate driver 300 is configured to generate a gate signal based on a control of the timing controller 400 and to output the gate signal to the gate line GL. The gate signal may be sequentially output to the plurality of gate lines GL. The gate signal may include a pre-charge pulse and a main-charge pulse according to an N−2 pre-charging mode. For example, according to the N−2 pre-charging mode, a pre-charge pulse of an N-th gate signal is used to pre-charge a data voltage of pixels in an (N−2)-th pixel row (e.g., a horizontal line), to pixels in an N-th pixel row (e.g., a horizontal line). The main-charge pulse of the N-th gate signal charges a self data voltage to the pixels in the N-th horizontal line.

The timing controller 400 is configured to receive image data IN_DATA and an input control signal CONT from an external graphics processor. The image data IN_DATA may include red image data R, green image data G and blue image data B. The input control signal CONT may include a master clock signal and a data enable signal. The input control signal CONT may further include a vertical synchronization signal and a horizontal synchronization signal.

The timing controller 400 is configured to generate a first control signal CONT1, a second control signal CONT2 and a data signal DATA, based on the image data IN_DATA and the input control signal CONT.

The timing controller 400 is configured to generate the first control signal CONT1 for controlling the gate driver 300 based on the input control signal CONT and to output the first control signal CONT1 to the gate driver 300. The first control signal CONT1 may include a vertical start signal and a gate clock signal.

The timing controller 400 is configured to generate the second control signal CONT2 for controlling the data driver 200 based on the input control signal CONT and to output the second control signal CONT2 to the data driver 200. The second control signal CONT2 may include a horizontal start signal and a load signal.

The timing controller 400 is configured to generate the data signal DATA based on the image data IN_DATA and to output the data signal DATA to the data driver 200. The data driver 200 is configured to convert the data signal DATA into a data voltage using a gamma voltage and to output the data voltage to the data line DL.

The timing controller 400 is configured to compare image data of an (N−2)-th horizontal line and image data of an N-th horizontal line, and generate a pre-charge control signal GM1 and GM2 for controlling a pre-charging of the N-th horizontal line.

The gate driver 300 is configured to receive the pre-charge control signal GM1 and GM2 and to determine whether to generate a pre-charge pulse of the N-th gate signal corresponding to the N-th horizontal line in response to the pre-charge control signal GM1 and GM2. For example, the timing controller 400 is configured to compare the image data of the N-th and (N−2)-th horizontal lines. The timing controller 400 is configured to generate a pre-charge control signal having a first level (e.g., a high level) during a pre-charge period of an N-th gate signal if a comparison result of the image data of the N-th and (N−2)-th horizontal lines satisfies a ghost condition, and to generate a pre-charge control signal having a second level (e.g., a low level) during a pre-charge period of the N-th gate signal if a comparison result does not satisfy the ghost condition.

Therefore, the image data which include a ghost defect is detected, and thus the ghost defect may be decreased and/or eliminated.

Figure 2:
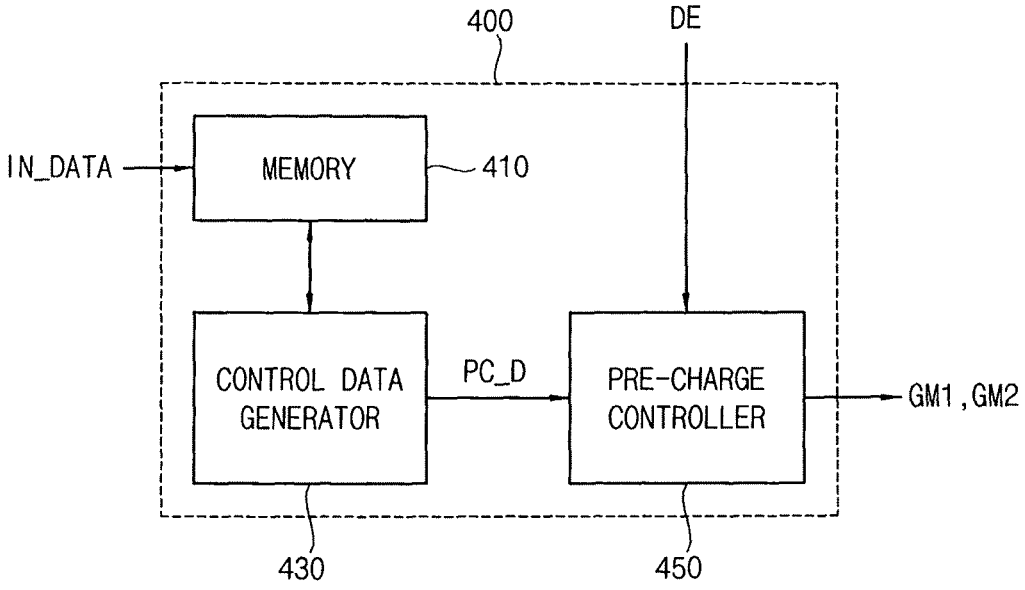
FIG. 2 is a block diagram illustrating a timing controller in FIG. 1 according to an exemplary embodiment of the inventive concept.

FIG. 2 is a block diagram illustrating a timing controller in FIG. 1 according to an exemplary embodiment of the inventive concept.

Referring to FIG. 2, the timing controller 400 may include a memory 410, a control data generator 430 and a pre-charge controller 450.

The memory 410 stores the image data IN_DATA. The memory 410 may be utilized for performing various functions of the timing controller 400.

The control data generator 430 is configured to analyze image data of an (N−2)-th horizontal line and image data of an N-th horizontal line for driving with an N−2 pre-charge driving mode.

For example, the control data generator 430 is configured to calculate comparison data of the (N−2)-th horizontal line using the image data of the (N−2)-th horizontal line.

The comparison data may include average data, high-number data and low-number data. The average data is an average value of image data of a horizontal line, for example. The high-number data is a counting value counting number of the image data of the horizontal line having a grayscale higher than a high threshold grayscale H_TH, for example. The low-number data is a counting value counting number of the image data of the horizontal line having a grayscale lower than a low threshold grayscale L_TH, for example.

The control data generator 430 is configured to analyze the comparison data of the (N−2)-th and N-th horizontal lines, and to determine whether the image data of the (N−2)-th and N-th horizontal lines has a ghost condition. The control data generator 430 is configured to generate pre-charge control data PC_D for controlling a pre-charging of the N-th horizontal line in accordance with an analysis result of the comparison data of the (N−2)-th and N-th horizontal lines. For example, if the (N−2)-th and N-th horizontal lines have the ghost condition, the control data generator 430 is configured to determine the pre-charge control data PC_D of the N-th horizontal line as first data (e.g., high data) '1'. However, if the (N−2)-th and N-th horizontal lines do not have the ghost condition, the control data generator 430 is configured to determine the pre-charge control data PC_D of the N-th horizontal line as second data (e.g., low data) '0'.

The pre-charge controller 450 is configured to generate a pre-charge control signal GM1 and GM2 in synchronization with a data enable signal DE based on pre-charge control data PC_D of each horizontal line provided from the control data generator 430.

The pre-charge control signal may include a first pre-charge control signal GM1 and a second pre-charge control signal GM2. The first pre-charge control signal GM1 controls a pre-charge pulse of a first odd-numbered gate signal among odd-numbered gate signals and a pre-charge pulse of a first even-numbered gate signal among even-numbered gate signals. The second pre-charge control signal GM2 controls a pre-charge pulse of a second odd-numbered gate signal among the odd-numbered gate signals and a pre-charge pulse of a second even-numbered gate signal among the even-numbered gate signals.

The first odd-numbered gate signal is an odd-numbered signal among the odd-numbered gate signals, and the second odd-numbered gate signal is an even-numbered signal among the odd-numbered gate signals. The first even-numbered gate signal is an odd-numbered signal among the even-numbered gate signals, and the second even-numbered gate signal is an even-numbered signal among the even-numbered gate signals.

Figure 4:
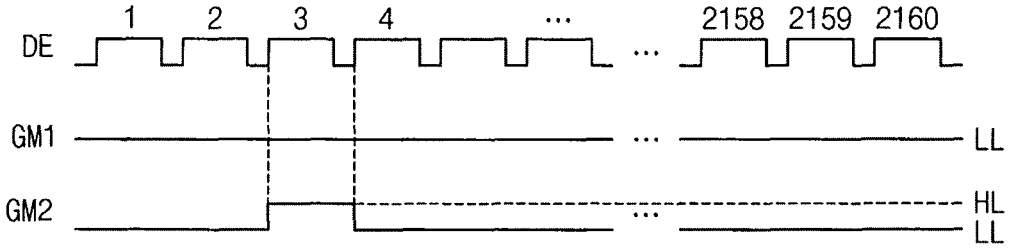
FIG. 4 is a diagram illustrating a method of driving a pre-charge controller in FIG. 2 according to an exemplary embodiment of the inventive concept.

FIGS. 3A and 3B are diagrams illustrating a method of driving a control data generator in FIG. 2 according to an exemplary embodiment of the inventive concept. FIG. 4 is a diagram illustrating a method of driving a pre-charge controller in FIG. 2 according to an exemplary embodiment of the inventive concept.

Referring to FIGS. 2 and 3A, when the display panel is Ultra High Definition (UHD), comparison data of each horizontal line may correspond to data shown in FIG. 3A.

The control data generator 430 is configured to calculate the comparison data of each horizontal line such as the data shown in FIG. 3A. Average data D_AVG of a first horizontal line are '230', the high-number data H_COUNT of the first horizontal line are '7000' and the low-number data L_COUNT of the first horizontal line are '10'. Average data D_AVG of a second horizontal line are '128', high-number data H_COUNT of the second horizontal line are '15' and the low-number data L_COUNT of the second horizontal line are '12'. Average data D_AVG of a third horizontal line are '12', high-number data H_COUNT of the third horizontal line are '0', low-number data L_COUNT of the third horizontal line are '6800'. Average data D_AVG of the fourth horizontal line are '160', high-number data H_COUNT of the fourth horizontal line are '160' and low-number data L_COUNT of the fourth horizontal line are '50'. Average data D_AVG of the fifth horizontal line are '91', high-number data H_COUNT of the fifth horizontal line are '91' and low-number data L_COUNT of the fifth horizontal line are '79'.

Average data D_AVG of horizontal line 2159 are '240', high-number data H_COUNT of the horizontal line 2159 are '7100' and low-number data L_COUNT of the horizontal line 2159 are '3'. Average data D_AVG of horizontal line 2160 are '245', high-number data H_COUNT of the horizontal line 2160 are '7200' and low-number data L_COUNT of the horizontal 2160 line are '6'.

The control data generator 430 is configured to analyze the comparison data of the (N−2)-th and N-th horizontal lines and to determine whether the (N−2)-th and N-th horizontal lines have a ghost condition.

For example, the control data generator 430 is configured to analyze comparison data of the first and third horizontal lines 1 and 3, and analyze comparison data of the second and fourth horizontal lines 2 and 4. According to an analysis result, the control data generator 430 is configured to determine whether the comparison data of the first and third horizontal lines 1 and 3 has the ghost condition, or to determine whether the comparison data of the second and fourth horizontal lines 2 and 4 do not have the ghost condition.

According to the analysis result, the control data generator 430 is configured to generate pre-charge control data PC_D of each horizontal line. In FIG. 3A, the result for the first horizontal line 1 is "High", the result for the second horizontal line 2 is "Don't care", the result for the third horizontal line 3 is "Low", the result for the fourth horizontal line 4 is "Don't care", the result for the fifth horizontal line 5 is "Don't care", the result for horizontal line 2159 is "High", and the result for horizontal line 2160 is "High".

FIG. 3B is a table illustrating pre-charge control data of each horizontal line corresponding to the comparison data of each horizontal line shown in FIG. 3A. Referring to FIG. 3B, the control data generator 430 is configured to determine the pre-charge control data PC_D of the third horizontal line 3 as the high data '1' because the comparison data of the first and third horizontal lines 1 and 3 is indicative of the ghost condition. The control data generator 430 is configured to determine the pre-charge control data PC_D of the remaining horizontal lines 1, 2, 4, 5, 6, . . . , 2160 as the low data '0' because the comparison data of the remaining horizontal lines is indicative of no ghost condition.

The pre-charge controller 450 is configured to generate first and second pre-charge control signals GM1 and GM2 based on the pre-charge control data PC_D and the data enable signal DE.

The first and second pre-charge control signals GM1 and GM2 may be generated in synchronization with the data enable signal DE which includes a pulse repeated by a horizontal period. In the N−2 pre-charge driving mode, a pre-charge period of an N-th gate signal corresponding to an N-th horizontal line may correspond to an N-th pulse period of the data enable signal DE. For example, a third pulse period of the data enable signal DE corresponding to the third horizontal line 3 corresponds to a pre-charge period of a third gate signal.

FIG. 4 is a waveform diagram illustrating the first and second pre-charge control signals GM1 and GM2 based on the pre-charge control data in FIG. 3B. Referring to FIGS. 3B and 4, when the pre-charge control data PC_D of the third horizontal line 3 are '1' and the pre-charge control data PC_D of the remaining horizontal lines are '0', the third horizontal line 3 is a second odd-numbered horizontal line among the odd-numbered horizontal lines and thus may be utilized to generate a second pre-charge control signal GM2.

Thus, the pre-charge controller 450 is configured to generate the second pre-charge control signal GM2 having a high level HL during the third pulse period of the data enable signal DE corresponding to the third horizontal line 3 and a low level LL during remaining pulse periods (e.g., 1, 2, 4, . . . 2160) except for the third pulse period. In addition, the pre-charge controller 450 is configured to generate a first pre-charge control signal GM1 having a low level LL during all pulse periods of the data enable signal DE.

Figure 5:
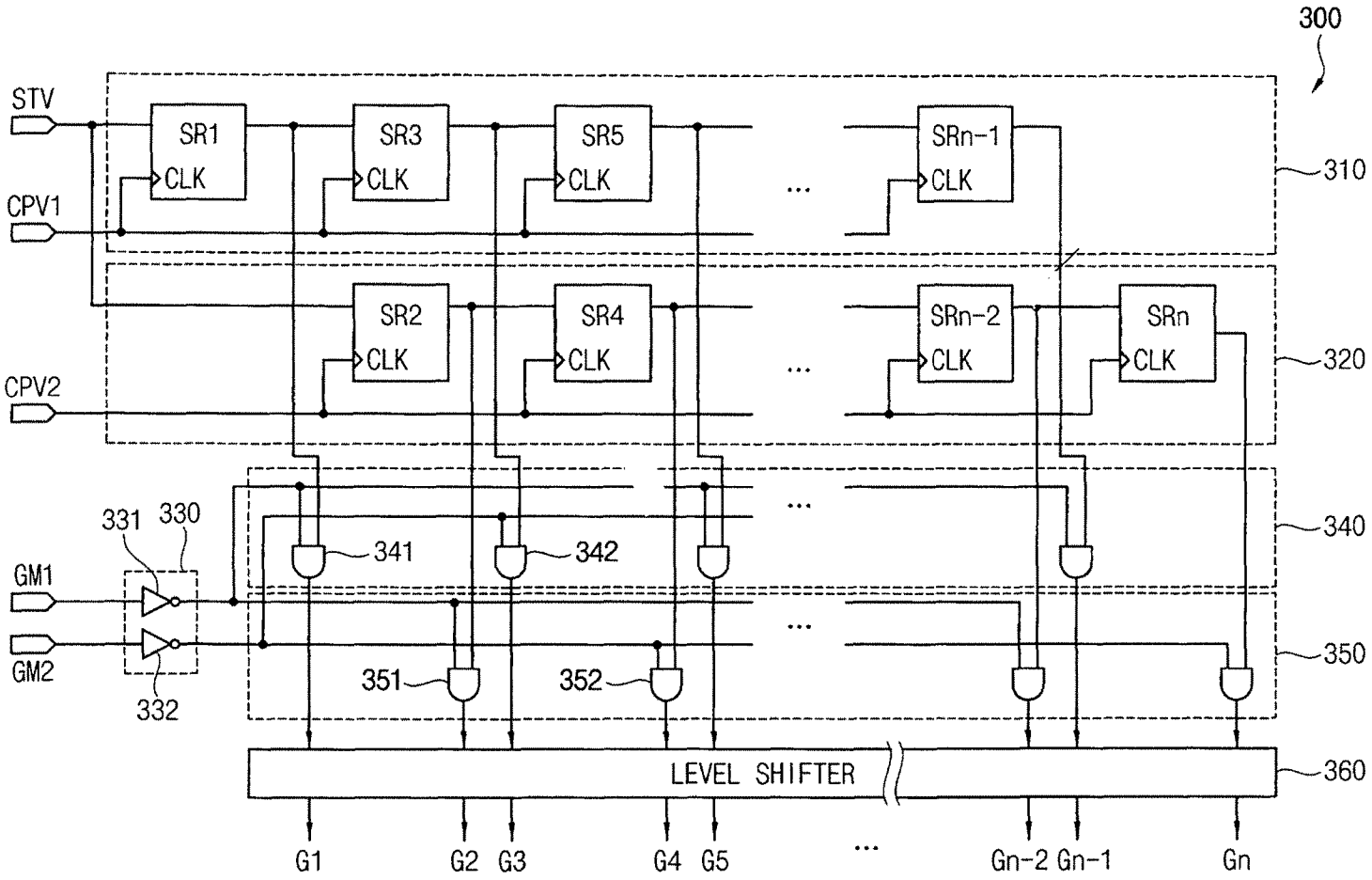
FIG. 5 is a block diagram illustrating a gate driver in FIG. 1 according to an exemplary embodiment of the inventive concept.
Figure 6:
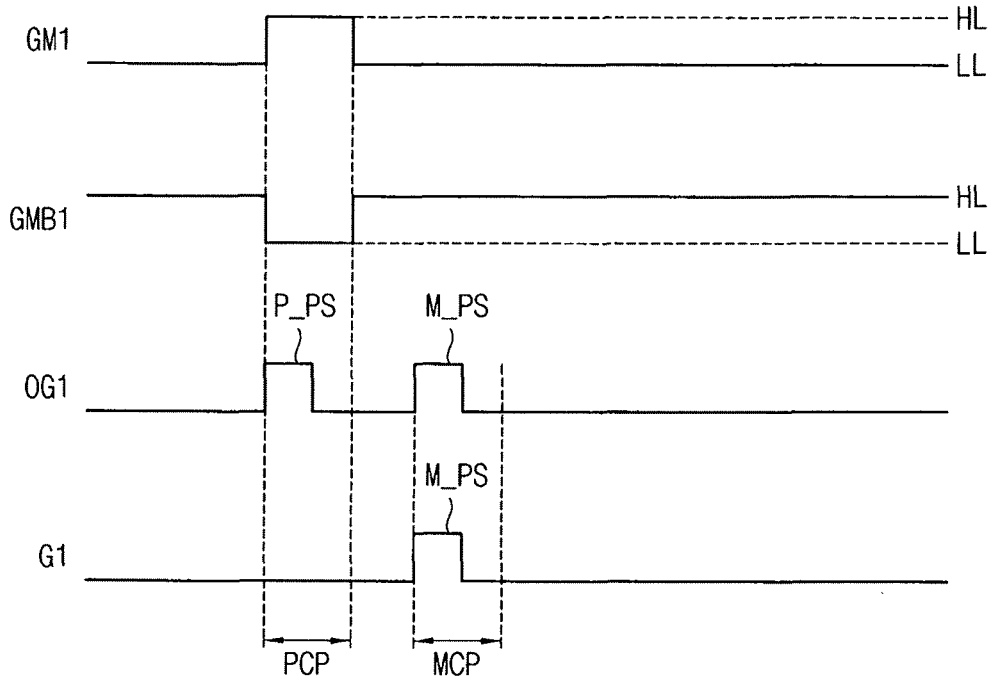
FIG. 6 is a waveform diagram illustrating a pre-charge adjustor in FIG. 5 according to an exemplary embodiment of the inventive concept.

FIG. 5 is a block diagram illustrating a gate driver in FIG. 1 according to an exemplary embodiment of the inventive concept. FIG. 6 is a waveform diagram illustrating a pre-charge adjustor in FIG. 5 according to an exemplary embodiment of the inventive concept.

Referring to FIGS. 1 and 5, the gate driver 300 may include a first shift-register 310, a second shift-register 320, a phase inverter 330, a first pre-charge adjustor 340, a second pre-charge adjustor 350 and a level shifter 360.

The first shift-register 310 may include a plurality of odd-numbered stages SR1, SR3, SR5, . . . , and SRn−1. The odd-numbered stages SR1, SR3, SR5, . . . , and SRn−1 are configured to generate odd-numbered original gate signals in synchronization with a first gate clock signal CPV1 in response to a vertical start signal STV. Each of the odd-numbered original gate signals may include a pre-charge pulse and a main-charge pulse delayed from the pre-charge pulse by one horizontal period (1H) according to an N−2 pre-charge driving mode.

The second shift-register 320 may include a plurality of even-numbered stages SR2, SR4, . . . , SRn−2, and SRn. The even-numbered stages SR2, SR4, . . . , SRn−2, and SRn are configured to generate even-numbered original gate signals in synchronization with a second gate clock signal CPV2 different from the first gate clock signal CPV1 in response to the vertical start signal STV. Each of the even-numbered gate signals may include a pre-charge pulse and a main-charge pulse delayed form the pre-charge pulse by one horizontal period (1H) according to the N−2 pre-charge driving mode.

The phase inverter 330 may include a first inverter 331 and a second inverter 332. The first inverter 331 is configured to invert a phase of the first pre-charge control signal GM1. The second inverter 332 is configured to invert a phase of the second pre-charge control signal GM2.

The first pre-charge adjustor 340 may include a first AND-circuit 341 and a second AND-circuit 342. The first AND-circuit 341 may include an input terminal which is connected to an output terminal of the first inverter 331 and an output terminal of first odd-numbered stage SR1 among the odd-numbered stages SR1, SR3, SR5, . . . , and SRn−1 and an output terminal which is connected to the level shifter 360. The second AND-circuit 342 may include an input terminal which is connected to an output terminal of the second inverter 332 and an output terminal of the second odd-numbered stage SR3 among the odd-numbered stages SR1, SR3, SR5, . . . , and SRn−1 and an output terminal which is connected to the level shifter 360. The first pre-charge adjustor 340 includes additional first AND-circuits and second AND-circuits (see the AND-circuits to the right of 341 and 342). These AND-circuits are connected similarly to the AND-circuits just described.

For example, referring to FIG. 6, the first inverter 331 is configured to receive the first pre-charge control signal GM1, to invert a phase of the first pre-charge control signal GM1 and to output a first inversion pre-charge control signal GMB1. The first AND-circuit 341 is configured to receive a first original gate signal OG1 of a first stage SR1 and the first inversion pre-charge control signal GMB1, to perform an AND operation on the first original gate signal OG1 and the first inversion pre-charge control signal GMB1, and to output a first gate signal G1.

When the first pre-charge control signal GM1 has a high level during a pre-charge period PCP of the first gate signal G1 and a low level during a remaining period of the first gate signal G1, the first inversion pre-charge control signal GMB1 has the low level during a period corresponding to the pre-charge period PCP and the high level during a period corresponding to the remaining period.

The first stage SR1 is configured to output a first original gate signal OG1 which has a pre-charge pulse P_PS corresponding to the pre-charge period PCP and a main-charge pulse M_PS corresponding to a main-charge period MCP based on the first gate clock signal CPV1.

The first AND-circuit 341 is configured to perform the AND operation on the first inversion pre-charge control signal GMB1 and the first original gate signal OG1. The first AND-circuit 341 is configured to output the first gate signal G1 which has the low level during the pre-charge period PCP in which the first inversion pre-charge control signal GMB1 has the low level.

Therefore, the first gate signal G1 may include only main-charge pulse M_PS without the pre-charge pulse P_PS according to the first pre-charge control signal GM1. As described above, the pre-charge pulse of the original gate signal OG1 may be controlled.

The second pre-charge adjustor 350 may include a third AND-circuit 351 and a fourth AND-circuit 352. The third AND-circuit 351 may include an input terminal which is connected to an output terminal of the first inverter 331 and an output terminal of first even-numbered stage SR2 among the even-numbered stages SR2, SR4, SR6, . . . , SRn−2, and SRn and an output terminal which is connected to the level shifter 360. The fourth AND-circuit 352 may include an input terminal which is connected to an output terminal of the second inverter 332 and an output terminal of second even-numbered stage SR4 among the even-numbered stages SR2, SR4, SR6, . . . , SRn−2, and SRn and an output terminal which is connected to the level shifter 360. The second pre-charge adjustor 350 includes additional third AND-circuits and fourth AND-circuits (see the AND-circuits to the right of 351 and 352). These AND-circuits are connected similarly to the AND-circuits just described. Methods of driving the second pre-charge adjustor 350 are substantially the same as those of the first pre-charge adjustor 340 described referring to FIG. 6.

The level shifter 350 is configured to shift levels of a plurality of gate signals G1, G2, G3, G4, . . . , Gn−2, Gn−1 and Gn outputted from the first to fourth AND-circuits 341, 342, 351 and 352 and to output the plurality of gate signals G1, G2, G3, G4, . . . , Gn−2, Gn−1 and Gn to the gate lines GL of the display panel 100.

Figure 7:
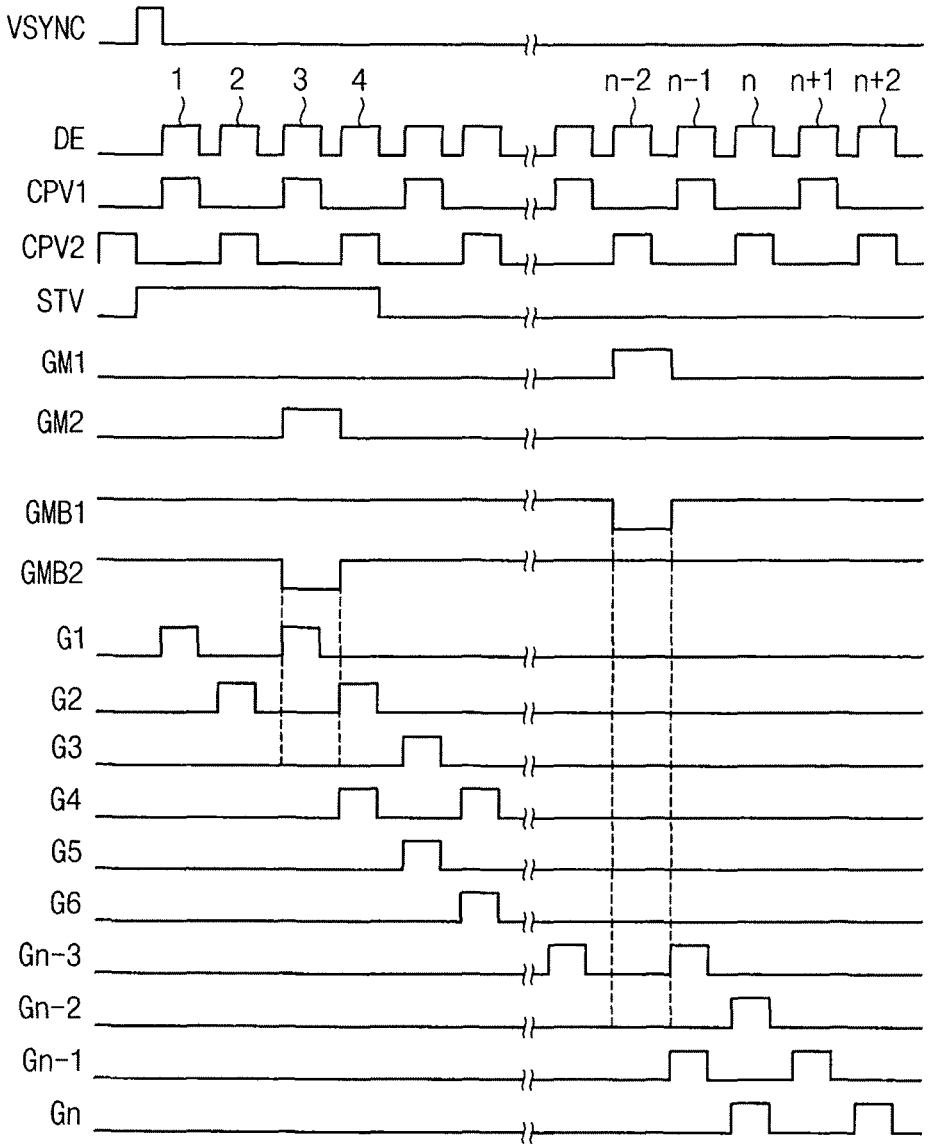
FIG. 7 is a waveform diagram illustrating input and output signals of the gate driver in FIG. 5 according to an exemplary embodiment of the inventive concept.

FIG. 7 is a waveform diagram illustrating input and output signals of the gate driver in FIG. 5 according to an exemplary embodiment of the inventive concept.

Referring to FIGS. 2, 5 and 7, for example, first and third horizontal lines 1 and 3 have a ghost condition and N-th−4 and (N−2)-th horizontal lines do not have the ghost condition. The pre-charge controller 450 is configured to generate a first pre-chare control signal GM1 and a second pre-charge control signal GM2, and output the first and second pre-chare control signals GM1 and GM2 to the gate driver 300.

The first pre-charge control signal GM1 has a high level HL during a pre-charge period of an (N−2)-th gate signal corresponding to the (N−2)-th horizontal line and a low level LL during a remanding period (in other words, before and after the pre-charge period of the (N−2)-th gate signal). The pre-charge period of an (N−2)-th gate signal may correspond to an (N−2)-th pulse period n−2 of the data enable signal DE. The second pre-charge control signal GM2 has the high level HL during a pre-charge period of a third gate signal corresponding to the third horizontal line 3 and the low level LL during a remanding period (in other words, before and after the pre-charge period of the third gate signal). The pre-charge period of the third gate signal may correspond to a third pulse period 3 of the data enable signal DE.

The first shift-register 310 may include a plurality of odd-numbered stages SR1, SR3, SR5, . . . , and SRn−1. The odd-numbered stages SR1, SR3, SR5, . . . , SRn−3 and SRn−1 are configured to sequentially output odd-numbered original gate signals in synchronization with a first gate clock signal CPV1 in response to a vertical start signal STV. The odd-numbered original gate signals may include a pre-charge pulse P_PS and a main-charge pulse M_PS as shown in FIG. 6.

The second shift-register 320 may include a plurality of even-numbered stages SR2, SR4, SR6, . . . , SRn−2 and SRn. The even-numbered stages SR2, SR4, SR6, . . . , SRn−2 and SRn are configured to sequentially output even-numbered original gate signals in synchronization with a second gate clock signal CPV2 in response to the vertical start signal STV. The even-numbered original gate signals may include a pre-charge pulse P_PS and a main-charge pulse M_PS as shown in FIG. 6.

The first inverter 331 is configured to receive the first pre-charge control signal GM1. The first pre-charge control signal GM1 has a high level HL during a pre-charge period of an (N−2)-th gate signal corresponding to the (N−2)-th horizontal line and a low level LL during a remanding period (in other words, before and after the pre-charge period of the (N−2)-th gate signal). The pre-charge period of an (N−2)-th gate signal may correspond to an (N−2)-th pulse period n−2 of the data enable signal DE.

The first inverter 331 is configured to output a first inversion pre-charge control signal GMB1 which has a phase opposite to a phase of the first pre-charge control signal GM1.

The second inverter 332 is configured to receive the second pre-charge control signal GM2. The second pre-charge control signal GM2 has the high level HL during a pre-charge period of a third gate signal corresponding to the third horizontal line 3 and the low level LL during a remanding period (in other words, before and after the pre-charge period of the third gate signal). The pre-charge period of the third gate signal may correspond to a third pulse period 3 of the data enable signal DE.

The second inverter 332 is configured to output a second inversion pre-charge control signal GMB2 which has a phase opposite to a phase of the second pre-charge control signal GM2.

The first pre-charge adjustor 340 is configured to control the odd-numbered original gate signal and the pre-charge pulse based on the first and second inversion pre-charge control signals GMB1 and GMB2. For example, the first pre-charge adjustor 340 is configured to generate an (N−2)-th gate signal Gn−2 without the pre-charge pulse P_PS in a pre-charge period of an (N−2)-th gate signal corresponding to the (N−2)-th horizontal line based on the first inversion pre-charge control signal GMB1. The pre-charge period of the (N−2)-th gate signal Gn−2 may correspond to an (N−2)-th pulse period n−2 of the data enable signal DE.

The second pre-charge adjustor 350 is configured to control the pre-charge pulse of the even-numbered original gate signal based on the first and second inversion pre-charge control signals GMB1 and GMB2. For example, the second pre-charge adjustor 350 is configured to generate a third gate signal G3 without the pre-charge pulse P_PS in a pre-charge period of a third gate signal corresponding to the third horizontal line 3 based on the second inversion pre-charge control signal GMB2. The pre-charge period of the third gate signal G3 may correspond to a third pulse period 3 of the data enable signal DE.

As described above, the gate driver 300 is configured to generate gate signals G1, G2, G3, . . . , and Gn and to sequentially output gate signals G1, G2, G3, . . . , and Gn to the gate lines GL of the display panel 100.

According to an exemplary embodiment of the inventive concept, image data of a horizontal line which displays a ghost defect is pre-detected and thus, a pre-charge pulse of the gate signal corresponding to the horizontal line which has the ghost defect is eliminated. Therefore, ghost defects may be eliminated.

While the inventive concept has been particularly shown and described with reference to exemplary embodiments thereof, it will be apparent to those of ordinary skill in the art that various changes in form and detail may be made thereto without departing from the spirit and scope of the inventive concept as defined by the following claims.

What is claimed is:

1. A gate driver, comprising:

a first shift-register comprising a plurality of odd-numbered stages, wherein the first shift-register outputs a plurality of odd-numbered original gate signals in synchronization with a first gate clock signal, wherein each of the odd-numbered original gate signals has a pre-charge pulse and a main-charge pulse;

a second shift-register comprising a plurality of even-numbered stages, wherein the second shift-register outputs a plurality of even-numbered original gate signals in synchronization with a second gate clock signal, wherein each of the even-numbered original gate signals has a pre-charge pulse and a main-charge pulse;

a first inverter configured to output a first inversion pre-charge control signal having a phase opposite to a phase of a first pre-charge control signal;

a second inverter configured to output a second inversion pre-charge control signal having a phase opposite to a phase of a second pre-charge control signal;

a first AND-circuit configured to perform an AND operation on a first odd-numbered original gate signal of the odd-numbered original gate signals and the first inversion pre-charge control signal;

a second AND-circuit configured to perform the AND operation on a second odd-numbered original gate signal of the odd-numbered original gate signals and the second inversion pre-charge control signal;

a third AND-circuit configured to perform an AND operation on a first even-numbered original gate signal of the even-numbered original gate signals and the first inversion pre-charge control signal; and a fourth AND-circuit configured to perform the AND operation on a second even-numbered original gate signal of the even-numbered original gate signals and the second inversion pre-charge control signal.

2. A display apparatus, comprising:

a display panel comprising a plurality of pixels arranged in a plurality of pixel rows and a plurality of pixel columns, and a plurality of horizontal lines corresponding to the plurality of pixel rows;

a control data generator configured to generate pre-charge control data of an N-th horizontal line by comparing image data of an (N−2)-th horizontal line and image data of the N-th horizontal line ('N' is a natural number);

a pre-charge controller configured to generate a pre-charge control signal based on the pre-charge control data; and a gate driver configured to generate an N-th gate signal having at least one of a pre-charge pulse and a main-charge pulse, wherein the main-charge pulse is delayed from the pre-charge pulse by one horizontal period, and gate drive is configured to control the pre-charge pulse of the N-th gate signal based on the pre-charge control signal such that the pre-charge pulse of the N-th gate signal is not generated when the comparison of the image data of the (N−2)-th horizontal line and the image data of the N-th horizontal line is indicative of a ghost condition.

3. The display apparatus of claim 2, wherein the control data generator is configured to calculate comparison data of the N-th horizontal line using the image data of the N-th horizontal line and calculate comparison data of the (N−2)-th horizontal line using the image data of the (N−2)-th horizontal line, and to determine the pre-charge control data as high data if the comparison data of the N-th and (N−2)-th horizontal lines have the ghost condition and determine the pre-charge control data as low data if the comparison data of the N-th and (N−2)-th horizontal lines do not have the ghost condition.

4. The display apparatus of claim 3, wherein the comparison data comprise average data of image data of a horizontal line, a high-number data counting number of the image data of the horizontal line being higher than a high threshold grayscale, and a low-number data counting number of the image data of the horizontal line being lower than a low threshold grayscale.

5. The display apparatus of claim 2, wherein the gate driver comprises:

a shift-register comprising a plurality of stages, wherein the shift register generates a plurality of original gate signals synchronized with a gate clock signal in response to a vertical synchronization signal, wherein each of the original gate signals has a pre-charge pulse and a main-charge pulse;

a first inverter configured to output a first inversion pre-charge control signal having a phase opposite to a phase of a first pre-charge control signal, wherein the first pre-charge control signal controls a pre-charge pulse of an odd-numbered original gate signal provided from an odd-numbered stage of the plurality of stages;

a second inverter configured to output a second inversion pre-charge control signal having a phase opposite to a phase of a second pre-charge control signal, wherein the second pre-charge control signal controls a pre-charge pulse of an even-numbered original gate signal provided from an even-numbered stage of the plurality of stages;

a first AND circuit configured to perform an AND operation on the odd-numbered original gate signal and the first inversion pre-charge control signal; and a second AND circuit configured to perform an AND operation on the even-numbered original gate signal and the second inversion pre-charge control signal.

6. The display apparatus of claim 2, wherein the gate driver comprises:

a first shift-register comprising a plurality of odd-numbered stages, wherein the first shift-register outputs a plurality of odd-numbered original gate signals in synchronization with a first gate clock signal, wherein each of the odd-numbered original gate signals has a pre-charge pulse and a main-charge pulse; and a second shift-register comprising a plurality of even-numbered stages, wherein the second shift-register outputs a plurality of even-numbered original gate signals in synchronization with a second gate clock signal, wherein each of the even-numbered original gate signal has a pre-charge pulse and a main-charge pulse.

7. The display apparatus of claim 6, wherein the gate driver further comprises:

a first inverter configured to output a first inversion pre-charge control signal having a phase opposite to a phase of a first pre-charge control signal;

a second inverter configured to output a second inversion pre-charge control signal having a phase opposite to a phase of a second pre-charge control signal;

a first AND circuit configured to perform an AND operation on a first odd-numbered original gate signal of the odd-numbered original gate signals and the first inversion pre-charge control signal;

a second AND circuit configured to perform the AND operation on a second odd-numbered original gate signal of the odd-numbered original gate signals and the second inversion pre-charge control signal;

a third AND circuit configured to perform the AND operation on a first even-numbered original gate signal of the even-numbered original gate signals and the first inversion pre-charge control signal; and a fourth AND circuit configured to perform the AND operation on a second even-numbered original gate signal of the even-numbered original gate signals and the second inversion pre-charge control signal.

8. A method of driving a display apparatus which comprises a plurality of pixels arranged in a plurality of pixel rows and a plurality of pixel columns and a plurality of horizontal lines corresponding to the plurality of pixel rows, the method comprising:

generating pre-charge control data of an N-th horizontal line by comparing image data of an (N−2)-th horizontal line and image data of the N-th horizontal line ('N' is a natural number);

generating a pre-charge control signal based on the pre-charge control data of the N-th horizontal line;

generating an N-th gate signal having a pre-charge pulse and a main-charge pulse delayed from the pre-charge pulse by one horizontal period; and omitting the pre-charge pulse of the N-th gate signal corresponding to the N-th horizontal line based on the pre-charge control signal which is indicative of a ghost condition.

9. The method of claim 8, further comprising:

calculating comparison data of the N-th horizontal line using the image data of the N-th horizontal line;

calculating comparison data of the (N−2)-th horizontal line using the image data of the (N−2)-th horizontal line; and determining the pre-charge control data as high data if the comparison data of the N-th and (N−2)-th horizontal lines have the ghost condition and determining the pre-charge control data as low data if the comparison data of the N-th and (N−2)-th horizontal lines do not have the ghost condition.

10. The method of claim 9, wherein the comparison data comprise average data of image data of a horizontal line, a high-number data counting number of the image data of the horizontal line being higher than a high threshold grayscale, and a low-number data counting number of the image data of the horizontal line being lower than a low threshold grayscale.

11. The method of claim 8, further comprising:

generating a plurality of original gate signals having a pre-charge pulse and a main-charge pulse in synchronization with a gate clock signal in response to a vertical synchronization signal;

outputting a first inversion pre-charge control signal having a phase opposite to a phase of a first pre-charge control signal;

outputting a second inversion pre-charge control signal having a phase opposite to a phase of a second pre-charge control signal;

performing an AND operation on the odd-numbered original gate signal and the first inversion pre-charge control signal; and performing the AND operation on the even-numbered original gate signal and the second inversion pre-charge control signal.

12. The method of claim 8, further comprising:

outputting a plurality of odd-numbered original gate signals having a pre-charge pulse and a main-charge pulse in synchronization with a first gate clock signal; and outputting a plurality of even-numbered original gate signals having a pre-charge pulse and a main-charge pulse in synchronization with a second gate clock signal.

13. The method of claim 12, further comprising:

outputting a first inversion pre-charge control signal having a phase opposite to a phase of a first pre-charge control signal, wherein the first pre-charge control signal controls a first odd-numbered original gate signal of the odd-numbered original gate signals and a first even-numbered original gate signal of the even-numbered original gate signals;

outputting a second inversion pre-charge control signal having a phase opposite to a phase of a second pre-charge control signal, wherein the second pre-charge control signal controls a second odd-numbered original gate signal of the odd-numbered original gate signals and a second even-numbered original gate signal of the even-numbered original gate signals;

performing a first AND operation on the first odd-numbered original gate signal and the first inversion pre-charge control signal;

performing a second AND operation on the second odd-numbered original gate signal and the second inversion pre-charge control signal;

performing a third AND operation on the first even-numbered original gate signal and the first inversion pre-charge control signal; and performing a fourth AND operation on the second even-numbered original gate signal and the second inversion pre-charge control signal.

14. A display apparatus, comprising:

a timing controller configured to generate pre-charge control data of an N-th signal line by comparing image data of an (N−2)-th signal line and image data of the N-th signal line ('N' is a natural number), and to generate a pre-charge control signal based on the pre-charge control data; and a gate driver configured to generate an N-th gate signal having a pre-charge pulse and a main-charge pulse delayed from the pre-charge pulse by a first time period, and to control the pre-charge pulse of the N-th gate signal based on the pre-charge control signal by inverting the pre-charge control signal and performing a logical operation on the inverted pre-charge control signal and an original N-th gate signal.

15. The display apparatus of claim 14, wherein the timing controller is configured to calculate comparison data of the N-th signal line using the image data of the N-th signal line, calculate comparison data of the (N−2)-th signal line using the image data of the (N−2)-th horizontal line, determine the pre-charge control data as high data if the comparison data of the N-th and (N−2)-th signal lines satisfy a first condition and determine the pre-charge control data as low data if the comparison data of the N-th and (N−2)-th signal lines do not satisfy the first condition.

16. The display apparatus of claim 15, wherein the first condition is a ghost condition.

17. The display apparatus of claim 14, wherein the signal lines are horizontal lines of a display panel.

* * * * *